US008899073B2

(12) United States Patent
Vreeland et al.

(10) Patent No.: US 8,899,073 B2
(45) Date of Patent: Dec. 2, 2014

(54) PARALLEL PLATE TYPE REFRIGERANT STORAGE DEVICE

(75) Inventors: Gary Scott Vreeland, Medina, NY (US); Frederick Vincent Oddi, Orchard Park, NY (US)

(73) Assignee: Delphi Technologies, Inc., Troy, MI (US)

( * ) Notice: Subject to any disclaimer, the term of this patent is extended or adjusted under 35 U.S.C. 154(b) by 336 days.

(21) Appl. No.: 13/325,161

(22) Filed: Dec. 14, 2011

(65) Prior Publication Data

US 2013/0153072 A1 Jun. 20, 2013

(51) Int. Cl.
*F25B 43/02* (2006.01)

(52) U.S. Cl.
USPC ..... 62/470; 62/468; 62/503; 62/474; 62/509; 62/529; 62/471; 62/473; 62/84; 62/85

(58) Field of Classification Search
CPC .... F25B 2400/16; F25B 43/006; F25B 43/00; F25B 2339/044
USPC ..... 62/474, 503, 509, 529, 84, 85, 62/317–318, 468, 470, 471, 473
See application file for complete search history.

(56) References Cited

U.S. PATENT DOCUMENTS

| | | | | |
|---|---|---|---|---|
| 3,830,077 | A | 8/1974 | Willen et al. | |
| 6,032,482 | A | 3/2000 | Krauss | |
| 6,463,757 | B1 | 10/2002 | Dickson et al. | |
| 2002/0026999 | A1 * | 3/2002 | Wu et al. | 165/167 |
| 2006/0254310 | A1 | 11/2006 | Kamsma | |

FOREIGN PATENT DOCUMENTS

EP 2196750 A2 6/2010

OTHER PUBLICATIONS

European Search Report dated Apr. 2, 2013.

* cited by examiner

*Primary Examiner* — Cheryl J Tyler
*Assistant Examiner* — Orlando E Aviles Bosques
(74) *Attorney, Agent, or Firm* — Lawrence D. Hazelton

(57) ABSTRACT

A refrigerant storage device that arranges two end plates to form a cavity and includes a turbulator plate within the cavity. The turbulator plate is arranged within the cavity to reinforce the cavity by providing a plurality of reinforcement portions between the end plates. The cavity is sized and the turbulator plate is configured so a liquid portion of refrigerant flowing through the cavity collects onto the turbulator plate. The device has a rectangular shape that simplifies vehicle packaging and allows the device to be readily integrated into a plate-type refrigerant-to-liquid coolant heat exchanger. The device is formed by a stacking arrangement of parts that provides for a readily scalable design.

5 Claims, 4 Drawing Sheets

PARALLEL PLATE TYPE REFRIGERANT STORAGE DEVICE

TECHNICAL FIELD OF INVENTION

This disclosure generally relates to refrigerant storage device, and more particularly relates to a rectangular shaped accumulator or receiver with internal reinforcement between end plates of the rectangular shape.

BACKGROUND OF INVENTION

Vehicle interior air conditioning systems based on refrigerant-to-air heat exchangers typically use round shaped receivers or accumulators as refrigerant storage devices to storage extra refrigerant. In the case of a typical receiver, the long and narrow shape of these round devices allow the device to contain refrigerant at high pressure with minimal container wall thickness and be packaged in a vehicle adjacent to or as part of the condenser assembly. However, these round devices are difficult to package in a vehicle because the round shape makes inefficient use of vehicle under-hood space. Furthermore, future systems based on refrigerant-to-coolant heat exchangers are being developed that would benefit from a storage device with a shape that was easily integrated into these refrigerant-to-coolant heat exchangers.

SUMMARY OF THE INVENTION

In accordance with one embodiment, a refrigerant storage device is provided. The refrigerant storage device includes a first end plate, a second end plate, and a turbulator plate. The second end plate is parallel to and spaced apart from the first end plate by a gap distance. The second end plate is coupled to the first end plate in a manner effective to define a cavity therebetween. The cavity defines an inlet opening and an outlet opening spaced apart from the inlet opening. The cavity is sized relative to the inlet opening such that a cavity velocity of refrigerant in the cavity is substantially less than an inlet velocity of refrigerant in the inlet opening. The turbulator plate is arranged within the cavity and configured to reinforce the cavity by providing a plurality of reinforcement portions between the first end plate and the second end plate. The turbulator plate is further configured such that a liquid portion of refrigerant flowing through the cavity collects onto the turbulator plate.

In one embodiment, the inlet opening and the outlet opening are positioned in an upper region of the device such that the device operates as an accumulator.

In an alternate embodiment, the inlet opening is positioned in an upper region of the device and the outlet opening is positioned in a lower region of the device such that the device operates as a receiver.

In another embodiment, the device includes a plurality of turbulator plates.

In another embodiment, the device includes a barrier plates between each adjacent turbulator plate.

In another embodiment, each barrier plate defines an edge around the perimeter of the barrier plate. The edge is configured to nest with an adjacent barrier plate in order to provide a perimeter seal of a portion of the cavity between adjacent barrier plates.

Further features and advantages will appear more clearly on a reading of the following detailed description of the preferred embodiment, which is given by way of non-limiting example only and with reference to the accompanying drawings.

BRIEF DESCRIPTION OF DRAWINGS

The present invention will now be described, by way of example with reference to the accompanying drawings, in which.

DETAILED DESCRIPTION

Figure 2:
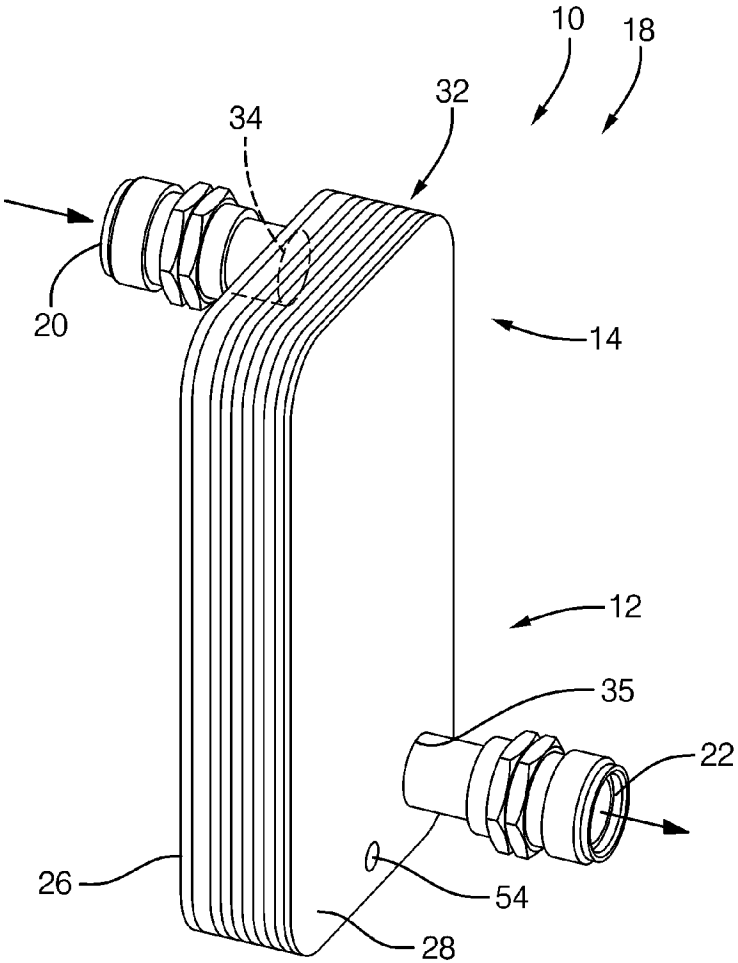
FIG. 2 is a perspective view of a refrigerator storage device in accordance with one embodiment.
Figure 1:
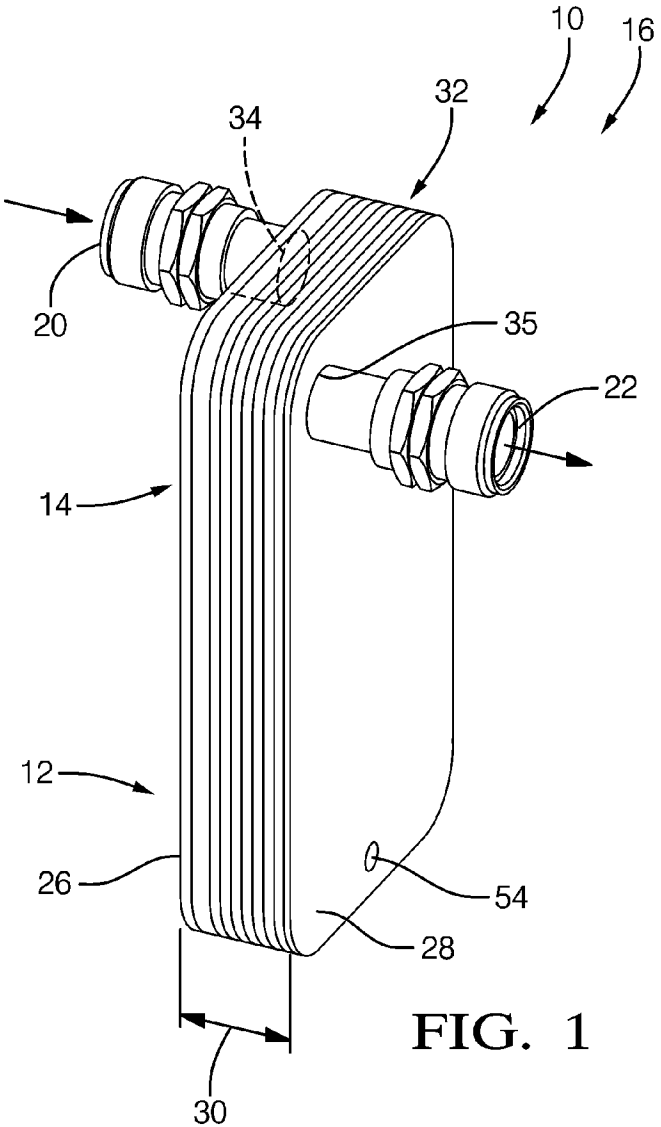
FIG. 1 is a perspective view of a refrigerator storage device in accordance with one embodiment.

FIGS. 1 and 2 illustrates a non-limiting examples of a refrigerant storage device 10, hereafter often device 10. As used herein, a refrigerant storage device provides a space where refrigerant that includes liquid and gaseous refrigerant is slowed, i.e. the local velocity of the refrigerant is reduced so the liquid refrigerant can be separated from the gaseous refrigerant. The device 10 is installed in an orientation similar to that shown in FIGS. 1 and 2 so that liquid refrigerant tends to pool in a lower region 12 of the device and gaseous refrigerant tends to occupy an upper region 14 of the device. As such, the device may be configured to operate as an accumulator 16 by locating an inlet 20 and an outlet 22 in the upper region 14. As used herein, an accumulator is a device configured to generally output refrigerant that has a greater fraction of refrigerant in the gaseous state than the refrigerant input into the accumulator. Alternatively, the device may be configured to operate as a receiver 18 by locating the inlet 20 in the upper region 14 and locating the outlet 22 in the lower region 12. As used herein, a receiver is a device configured to generally output refrigerant that is in the liquid state. In both examples, the inlet 20 is preferably located in the upper region 14 so any liquid refrigerant in the lower region 12 is not agitated by refrigerant entering the device 10. For the purpose of explanation and not limitation, suitable outside dimensions of the device 10 excluding the inlet 20 and outlet 22 are 100 millimeters by 175 millimeters by 35 millimeters.

Figure 3:
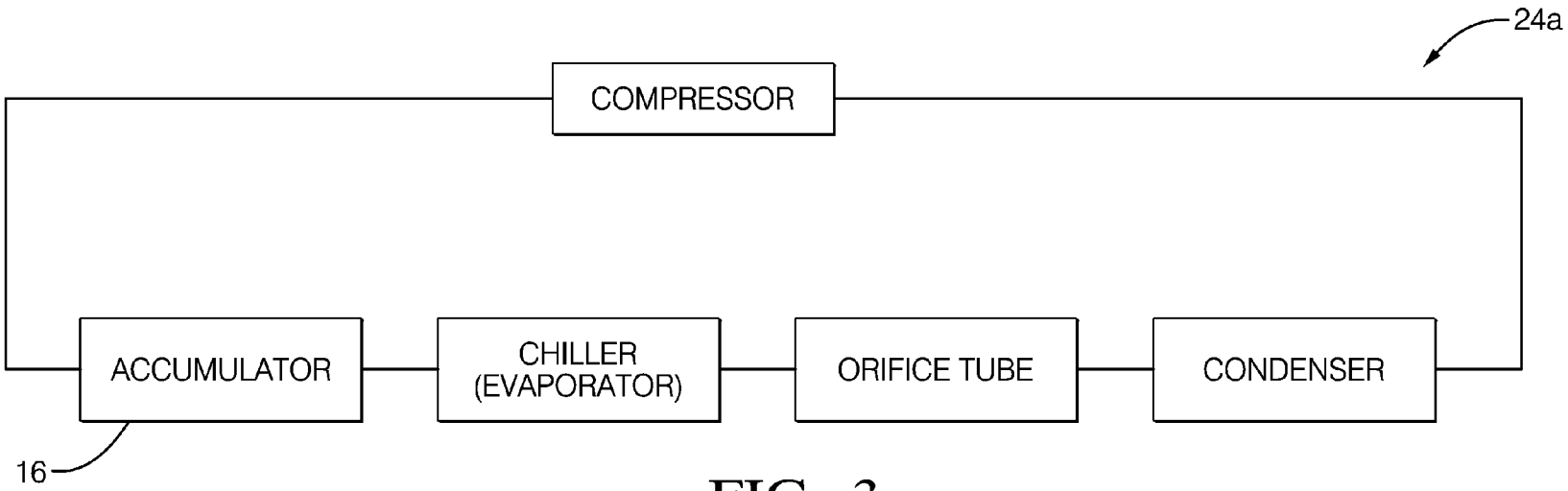
FIG. 3 is a diagram of a refrigeration system in accordance with one embodiment.

FIG. 3 illustrates a non-limiting example of a refrigeration system 24*a* suitable for use as part of a vehicle interior air-conditioning system that will be recognized by those skilled in the art. In this example, the system 24*a* includes the accumulator 16 described herein to reduce or prevent the occurrence of liquid refrigerant being received by the compressor.

Figure 4:
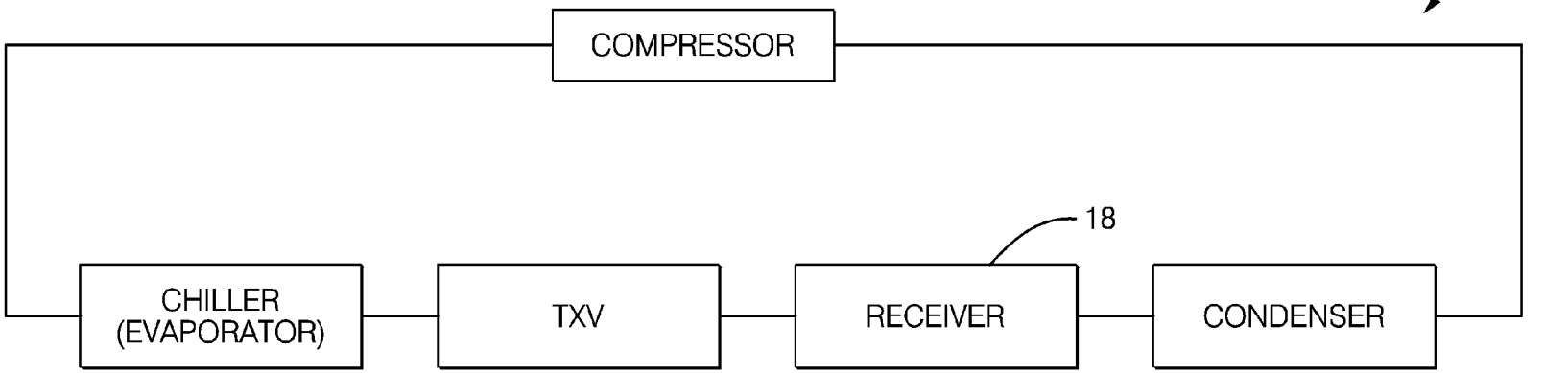
FIG. 4 is a diagram of a refrigeration system in accordance with one embodiment.

FIG. 4 illustrates another non-limiting example of a refrigeration system 24*b* also suitable for use as part of a vehicle interior air-conditioning system that will also be recognized by those skilled in the art. In this example, the system 24*b* includes the receiver 18 described herein to reduce or prevent the occurrence of gaseous refrigerant being received by the thermal expansion device (TVX) used to expand the high pressure, liquid refrigerant and high temperature refrigerant to low pressure, liquid/gas mix at low pressure for use in the chiller or evaporator. Another example system (not shown), places a sub-cooler between the receiver and the TXV. The function of the receiver remains the same, which is the receiver provides liquid to the sub-cooler that is then supplied the TXV.

Figure 5:
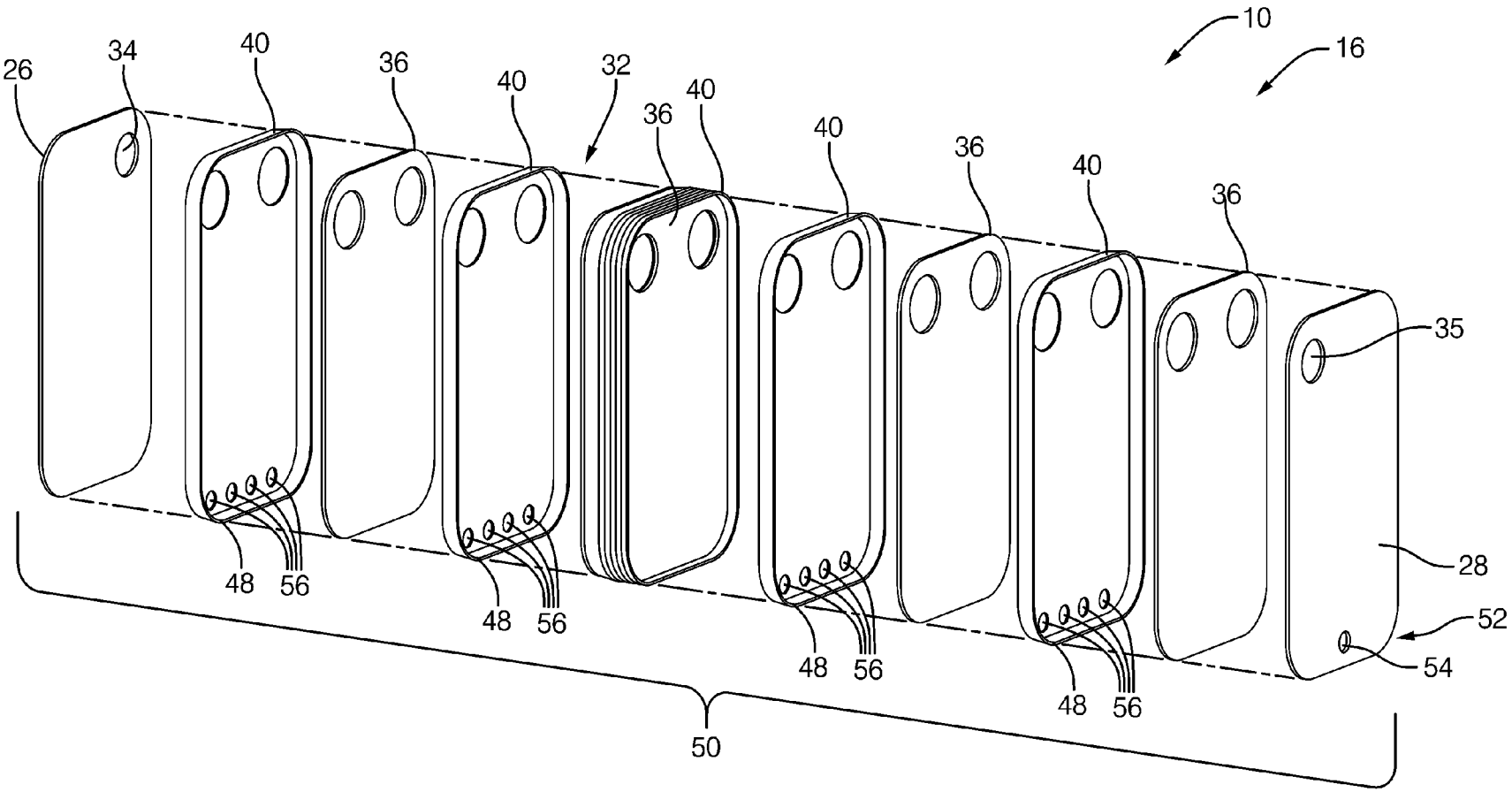
FIG. 5 is an exploded view of the refrigerator storage device of FIG. 1 in accordance with one embodiment.

FIG. 5 illustrates an exploded view of the device 10 configured as an accumulator 16 without the inlet 20 or outlet 22 included in the illustration. The device 10 may include a first end plate 26 and a second end plate 28 aligned with and parallel to the first end plate 26 as illustrated. The first end plate 26 and second end plate are spaced apart by a gap distance 30 (FIG. 1). In general, the first end plate 26 and the second end plate 28 are coupled to in a manner effective to define and seal a cavity 32 between the two plates.

The cavity 32 includes or defines an inlet opening 34 and an outlet opening 35 spaced apart from the inlet opening 34. In this non-limiting example, the inlet opening is show as being through the first end plate 26, and the outlet opening 35 is shown as being through the second end plate 28, however other configurations are envisioned such as drilling and installing the inlet 20 and/or outlet 22 into the top or sides of the device 10 after is it assembled into the rectangular shape shown in FIGS. 1 and 2.

In order for the liquid and gaseous refrigerant to more readily separate, the cavity 32 is sized relative to the inlet opening 34 such that a cavity velocity, i.e. the typical or average local velocity of refrigerant within the cavity 32 is substantially less than an inlet velocity, i.e. the typical or average local velocity of refrigerant within or passing through the inlet opening 34. As used herein, the cavity velocity is substantially less than the inlet velocity when the cavity velocity is low enough to allow gaseous and liquid refrigerant to separate, but the inlet velocity is preferably high enough so liquid and gaseous refrigerant stay mixed. In general, the inlet 20 and outlet 22 are preferably spaced about from each other to prevent a direct path from the inlet 20 to the outlet 22. By way of example and not limitation, with an inlet 20 of 13.3 mm diameter, a cavity depth of 34 mm, cavity length of 100 mm and the inlet 20 spaced from the outlet 22 by 59 mm it has been observed that separation of the liquid from gaseous refrigerant exist. In one embodiment not shown, the device 10 may include only the first end plate 26 and the second end plate 28 to provide a cavity for accumulating liquid refrigerant. However, an arrangement that includes other parts between the first end plate and the second end plate 28 is preferable for reasons that will become clear in the further description below.

Continuing to refer to FIG. 5, the device may include a turbulator plate 36 arranged within the cavity 32. In general, the turbulator provides two benefits. One function is that the turbulator plate 36 is fixedly attached to the first end plate 26 or the second end plate 28 in a manner effective to reinforce the first end plate 26 or the second end plate 28 so the end-plates can be made of thinner material and not be deformed by the pressure of refrigerant within the cavity 32. Without the reinforcement provided by the turbulator plate 36, the first end plate 26 and the second end plate 28 would need to be made of thicker material to resist deforming when exposed to pressurized refrigerant, and so would cause the device to be undesirably heavier. The second benefit provided by the turbulator plate 36 is a tortuous path for refrigerant to travel so airborne particles of liquid refrigerant in the cavity 32 are likely to come in contact with the turbulator plate 36, accumulate with other liquid particles, and eventually accumulate or pool with other liquid refrigerant in the lower region 12 of the device 10.

Figure 6:
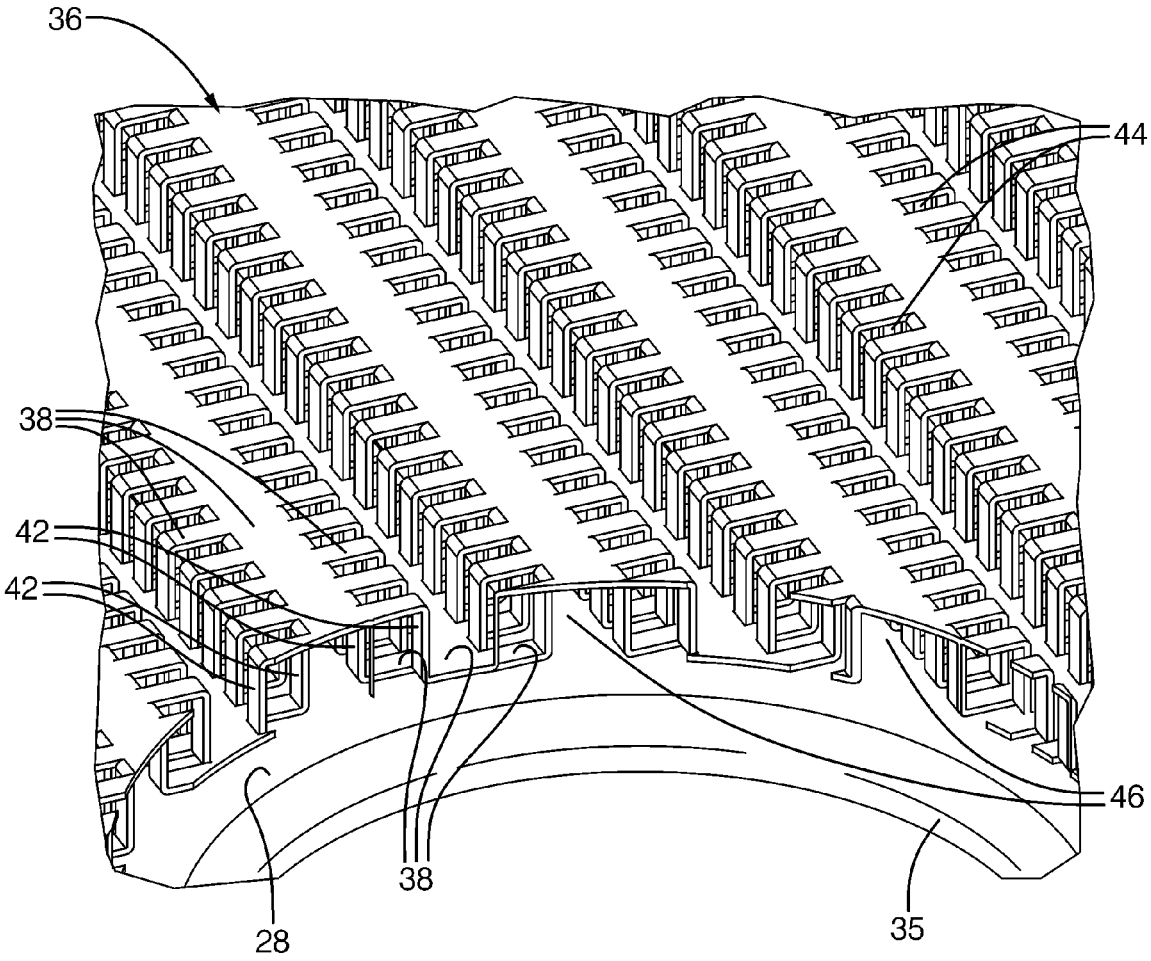
FIG. 6 is a perspective view of the turbulator plate of FIG. 5 in accordance with one embodiment.

FIG. 6 illustrates a non-limiting example of a turbulator plate 36 that defines various contact regions 38 that may be fixedly attached to, for example, the second end plate 28 as illustrated, the first end plate 26, or a barrier plate 40 (FIG. 5). The contact regions 38, or the entire tabulator plate 36, as well as the mating surface of the second end plate 28 in contact with the turbulator plate 36 may have a coating such as solder so the turbulator plate can be assembled attached to the second end plate 28 by subjecting the arrangement to a suitable solder reflow profile as is well known in the art. Alternatively, the turbulator plate 36 and/or barrier plate 40 may be formed of clad or unclad braze sheet, and the assembly would be exposed to an appropriate braze profile. The features illustrated in FIG. 6 may be characterized as a having a square-wave shape. Alternate shapes such as a sine-wave, triangle-wave, or saw-tooth-wave are also envisioned.

Reinforcement of the device 10 may be by way of reinforcement portions 42 arranged between the contact regions 38 fixedly attached to the first end plate 26, the second end plate 28, and or the barrier plate 40. The forming of the turbulator plate 36 may also provide a variety of slots 44 and/or passageways 46 arranged such that a liquid portion of refrigerant flowing through the cavity 32 collects onto the turbulator plate 36.

Referring again to FIG. 5, the device 10 may include multiple turbulator plates 36 arranged in an alternating manner with multiple barrier plates 40. In one embodiment, each barrier plate 40 may include an edge 48 extending around the perimeter of the barrier plate 40. The edge 48 may be configured to nest with an adjacent barrier plate in order to provide features and surfaces suitable for forming a perimeter seal of the portion of the cavity 32 between adjacent barrier plates by, for example, soldering, or brazing. With this edge 48, a stack 50 of alternating barrier plates 40 and turbulator plates 36 can be arranged with the first end plate 26 and the second end plate 28 to provide any desired volume of the cavity 32. As such, and advantage of the device 10 described herein is that the refrigerant handling capacity of the device can be easily optimized for each vehicle application.

The device 10 may also include an oil drain means 52 in the lower region 12, for example an oil drain hole 54 in the second end plate 28, and oil passages 56 in the barrier plates 40. The oil drain hole 54 may be coupled to a valve (not shown) or other similar device operable to regulate draining of oil that was mixed into the refrigerant from the device 10.

When refrigerant enters the cavity 32 of the device 10 via the inlet opening 34, the refrigerant is readily distributed along a pipe-like structure formed by the aligned holes in the barrier plates 40 and the turbulator plates 36. Refrigerant then passes parallel-wise through each of the portions of the cavity 32 defined by two adjacent barrier plates 40 spaced apart by a turbulator plate 36. Refrigerant capacity is increased by adding more layers of barrier plate 40 and turbulator plate 36 in order to increase the number of parallel pathways from pipe-like structure aligned with the inlet opening 34 to another pipe-like structure aligned with the output opening 35.

The plate-type-construction of the device 10 also allows for easy integration into a plate-type refrigerant-to-liquid coolant heat exchanger (not shown) that may include a refrigerant-to-liquid coolant sub-cooler and/or condenser. If the device is integrated into such a heat exchanger, the device 10 may further include an integral coolant manifold through the device to allow coolant to pass, for example, from the sub-cooler to the condenser without coolant entering the device 10.

Accordingly, a refrigerant storage device 10 is provided. The rectangular shape of the device 10 simplifies vehicle packaging and allows the device to be readily integrated into a plate-type refrigerant-to-liquid coolant heat exchanger. The stacking arrangement of parts forming the device provide for a readily scalable design.

While this invention has been described in terms of the preferred embodiments thereof, it is not intended to be so limited, but rather only to the extent set forth in the claims that follow.

We claim:

1. A refrigerant storage device comprising:

a first end plate;

a second end plate spaced apart from the first end plate;

at least three barrier plates interposed between the first end plate and the second end plate, wherein the first end plate, the second end plate and the at least three barrier plates have a rectangular shape and are arranged in parallel thereby comprising a stacking arrangement;

wherein each of the first end plate, the second end plate, and the at least three barrier plates are spaced apart to define a plurality of cavities and each of the at least three barrier plates nests adjacent barrier plates to form a perimeter seal effective to contain refrigerant within the device, wherein each cavity defines an inlet opening and an outlet opening spaced apart from the inlet opening; wherein refrigerant enters the refrigerant storage device via the inlet opening, said refrigerant is distributed along aligned holes in the at least three barrier plates, and the refrigerant flows in parallel in a downward direction through all the cavities, liquid refrigerant accumulates in a lower region of the storage device, and the cavities are sized relative to the inlet opening such that a cavity velocity of refrigerant in each cavity is substantially less than an inlet velocity of refrigerant in the inlet opening; and a turbulator plate arranged within at least one cavity of the plurality of cavities reinforcing the at least one cavity by providing a plurality of reinforcement portions between the plates that define the at least one cavity, wherein the turbulator plate is further configured such that a liquid portion of refrigerant flowing through the cavity collects onto the turbulator plate.

2. The device in accordance with claim 1, wherein the inlet opening and the outlet opening are positioned in an upper region of the device wherein the device comprises an accumulator.

3. The device in accordance with claim 1, wherein the inlet opening is positioned in an upper region of the device and the outlet opening is positioned in a lower region of the device wherein the device comprises a receiver.

4. The device in accordance with claim 1, wherein the device further comprises a plurality of turbulator plates arranged between adjacent barrier plates.

5. The device in accordance with claim 1, wherein the device further comprises an oil drain means in a lower region of the device.

* * * * *